US005226457A

United States Patent [19]

Gysin et al.

[11] Patent Number: 5,226,457

[45] Date of Patent: Jul. 13, 1993

[54] CORRUGATED SHAFT ROD AND A HEALD FRAME FOR A LOOM

[75] Inventors: Hansjörg Gysin; Wilhelm Servis, both of Winterthur, Switzerland

[73] Assignee: Sulzer Brothers Limited, Winterthur, Switzerland

[21] Appl. No.: 848,800

[22] Filed: Mar. 9, 1992

[30] Foreign Application Priority Data

Mar. 14, 1991 [CH] Switzerland ..... 777/91

[51] Int. Cl.[5] ..... D03C 9/06

[52] U.S. Cl. ..... 139/92; 428/902

[58] Field of Search ..... 139/91, 92; 428/116, 428/902, 284, 285

[56] References Cited

U.S. PATENT DOCUMENTS

| | | | |
|---|---|---|---|
| 2,697,453 | 12/1954 | Formenti | 139/91 X |
| 2,774,386 | 12/1956 | Formenti | 139/91 |
| 3,948,296 | 4/1976 | Koch | 139/91 |
| 4,777,987 | 10/1988 | Asagi et al. | 139/91 |
| 4,790,357 | 12/1988 | Kramer | 139/96 X |

FOREIGN PATENT DOCUMENTS

| | | | |
|---|---|---|---|
| 0302798 | 2/1989 | European Pat. Off. . | |
| 1020521 | 2/1953 | France . | |
| 1037843 | 9/1953 | France . | |
| 62-156331 | 7/1987 | Japan | 139/91 |
| WO88/05837 | 8/1988 | PCT Int'l Appl. . | |

*Primary Examiner*—Andrew M. Falik

*Attorney, Agent, or Firm*—Townsend and Townsend Khourie and Crew

[57] ABSTRACT

The shaft rod of a heald frame for a loom, the rod having a corrugated or cross-section, has a shell (16) made of a thermoplastics composite having industrial endless fibers. A rigid longitudinal reinforcement (17) is disposed on the outside of the section and a carrier or support rail or bar or the like (18) is disposed on the inside, the elements (17, 18) both being rigidly connected mechanically to the shell (16). Light rigid low-cost shaft rods and heald frames of simple construction are therefore provided.

26 Claims, 4 Drawing Sheets

CORRUGATED SHAFT ROD AND A HEALD FRAME FOR A LOOM

BACKGROUND OF THE INVENTION

The invention relates to a shaft rod of a heald frame for a loom, the rod containing fiber composites and having a flat cross-section, and to a heald frame having such rods.

The heald frames and shaft rods of modern looms must be able to withstand severe mechanical stressing. They have therefore conventionally been made of metal, steel being preferred for large cloth widths while aluminum is becoming increasingly popular for high-speed looms. The shaft rods are elaborate combinations of a large number of parts and are therefore relatively costly to produce. Also, they still have relatively high inert masses, something which is increasingly causing problems in the light of high and increasing loom speeds. Heald frames containing thermoset composite parts have already been disclosed. However, their production is still excessively elaborate and costly, their construction is complex and there are problems with them in long-term operation.

SUMMARY OF THE INVENTION

It is therefore the object of this invention to obviate these disadvantages and to provide improved shaft rods and the heald frames for which the same are used. The rods are required to be of simple construction, of reduced cost and capable of being produced rapidly, to have a reduced number of parts, low masses and/or increased stiffnesses and to have long working lives.

These problems are solved by shaft rods according to the invention which have a novel structure combined with novel composites and their arrangement provides improved mechanical properties and considerable simplifications and cost reductions. Basically, high strength and rigidity combined with reduced weight are achieved in a very simple way by a combination of the contoured shell structure with carrying and very rigid reinforcements on both sides at the flat ends of the section bar—i.e., by the external longitudinal reinforcement and the internal carrier bar, the latter carrying the healds and also being rigidly incorporated mechanically in the shaft rod. The mechanically strong contoured shell is effective as a lightweight and stable spacing device between these terminal longitudinal reinforcements. To this end, the outer longitudinal reinforcement and the inner carrier bar are each rigidly connected to the shell mechanically. Also, the thermoplastics matrix in the composite improves the endurance limit and notch strength of the rods and frame. The wide contouring of the shell increases flexural strength, provides substantial vibration damping and thus helps to reduce noise considerably.

The present invention also provides a large-area connection of the carrier bar and a longitudinal reinforcement of the contoured shell ensures a very advantageous and simple transmission of forces, the height of the connecting area being, with advantage, at least as great as the thickness of the carrier bar. Appropriate low-cost carrier bar constructions can be devised from a steel section member or a sheet steel section member. The longitudinal reinforcement can also be embodied by steel or aluminum sections or sheet steel sections. Very light and rigid constructions can be provided by unidirectional ("UD") Light and low-cost corrugated or contoured shells can contain least 50% glass fibers and ±45% glass fiber Polyphenylene sulfide ("PPS"), polyether imide ("polyamide ("PA"), polyether sulfon ("PES"), PSU"), polyurethane ("PUR") or polyethylene ("PE") are materials for the half-shells.

Very good rigidity is achieved if the contour shape merges at the inner end and outer end into a flat edge strip rigidly connected mechanically to the longitudinal reinforcement and the carrier bar. The shell can merge into two parallel flat, interrupted edge strips. Satisfactory introductions of forces in connecting zones can be ensured by the bearing surface being thermoplastically welded to the contoured shell. The same can have a wavy contour or trapezoidal contour which are simple to produce and which extend perpendicularly to the rod axis. Very satisfactory mechanical properties can be provided by means of periodic shell contours in which the ratio of the period P to the width B of the contour is between 3 and 8.

Heald frames which are stable and of very simple construction can be provided by identical symmetrically arranged top and bottom shaft rods.

DESCRIPTION OF THE PREFERRED EMBODIMENTS

Figure 1A:
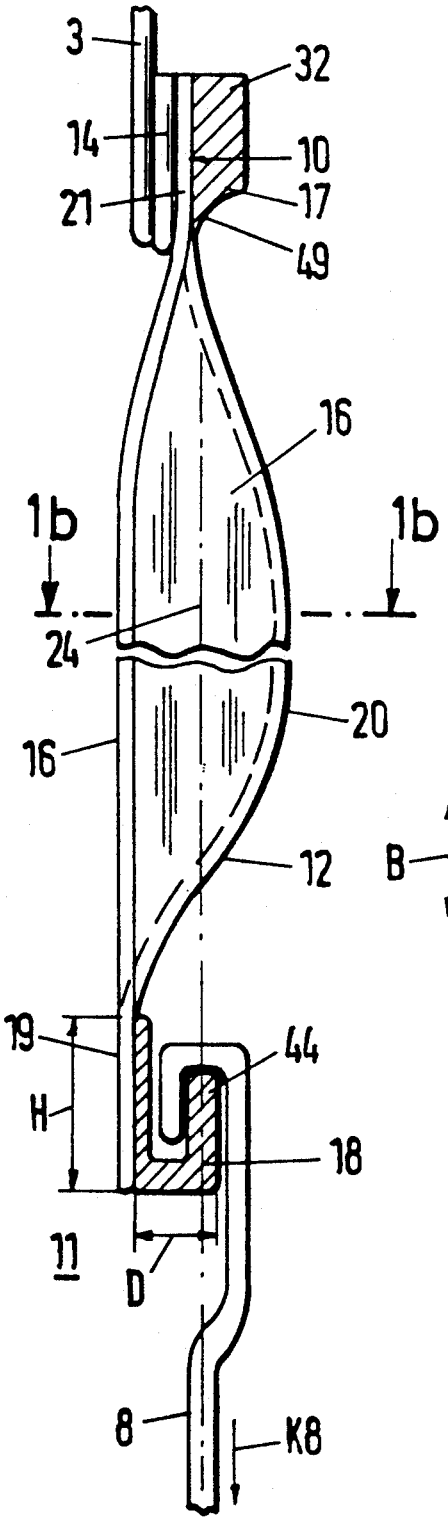
FIG. 1*a* is a view, in section, of a shaft rod according to the invention which has a wavy contoured shell and terminal longitudinal carriers.
Figure 6:
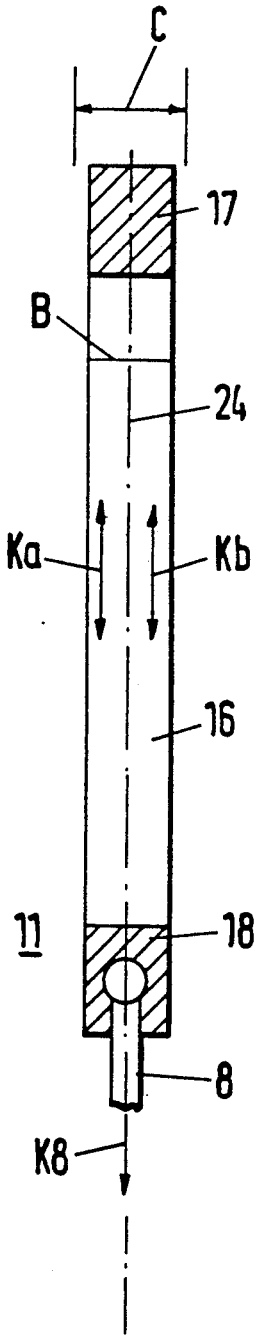
FIG. 6 shows, in section, a shaft rod constructed according to the invention.

The basic construction of the shaft rod according to the invention is shown in FIG. 6 and an embodiment is shown in FIG. 1*a*. In contrast to conventional shaft rods a shaft rod 11 according to the invention has a simple integrated construction in which two carrying longitudinal reinforcements 17, 18 are disposed one at each end of the flat rod 11, there being provided an outer longitudinal reinforcement 17 and an inner carrying bar 18, the latter carrying the healds 8 and therefore receiving the heald forces K8 (see also FIG. 7). The longitudinal carriers 17, 18 cooperate with a contoured shell 16 disposed between them to form a very light carrying structure which is very strong and has considerable strength with respect the heald forces K8. The very light and mechanically strong shell 16 is made of a thermoplastics composite having industrial endless fibers. The shell is effective as a spacer which transmits or receives the forces Ka, Kb between the carriers 17 and 18. If the shell 15 has a relatively large width B sufficient to occupy substantially completely the shaft pitch C—i.e., the space available for a heald frame—high flexural strength in respect of twisting moments produced by other forces is provided, so that vibrations are reduced or suppressed. There is therefore a considerable noise reduction. The novel construction enables the direction K8 of the heald forces to be displaced into the center plane 24 of the rod section, so that twisting forces are reduced. The mechanically rigid connection of the longitudinal carriers 17, 18 to the shell 16 is of considerable importance. Very light and rigid contoured shells can have, for example, a layer thickness of only 0.7 to 2 mm.

In the embodiment of FIG. 1*a* the longitudinal reinforcement is in the form of a unidirectional fibers ("This section, which has high specific strength and rigidity, is made of unidirectional carbon fibers or glass fibers in a thermoplastic matrix. A very satisfactory connection by way of the connecting surface 10 can be provided between the longitudinal reinforcement 17 and the shell 16 if both the latter elements have the same matrix material and are welded together thermoplastically at the connecting surface 10. Also, connections of this kind are simple and quick to make. On the inside of the rod a steel section 44 serving as carrier bar 18 for the healds 8 is rigidly connected to the shell 16 mechanically. The latter connection can be provided by screwing or riveting. Very advantageously, however, large-area connections are effected by bonding or welding or amorphous joining, quasi thermoplastic soldering. The steel section 44 is so devised that a relatively large connecting area 19 is provided. Advantageously, the height H thereof is greater than carrier bar thickness D. To simplify the suspension of the healds 8 in the bar 18 and to shift the heald forces K8 into the shaft rod center plane 24, the contoured shell 16 merges at both its ends into a flat edge strip 21 to which the longitudinal reinforcement 17 and the carrier bar 18 are rigidly connected mechanically.

Figure 1B:
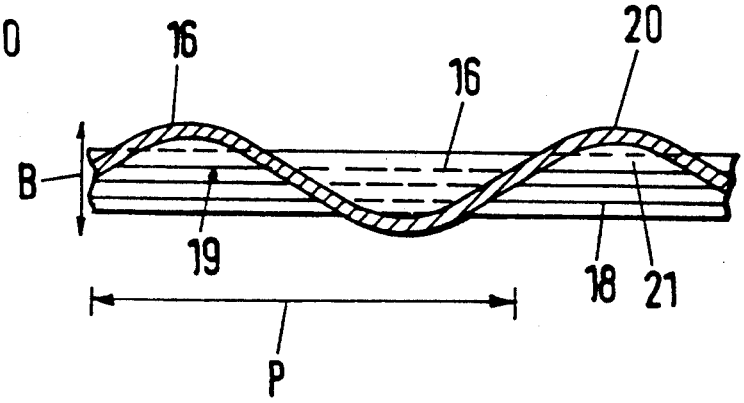
FIG. 1*b* is a longitudinal section through the rod of FIG. 1*a;*

In this case the shell 16 has a wavy contour 20, which extends in a non parallel manner to the longitudinal orientation of the reinforcement member on the shaft rod as will be apparent from the sectioned view of FIG. 1*b*. In periodic contoured shells a ratio of the period P to the width B of the contour of preferably 3 to 8 provides satisfactory mechanical properties and low weight.

Figure 2A:
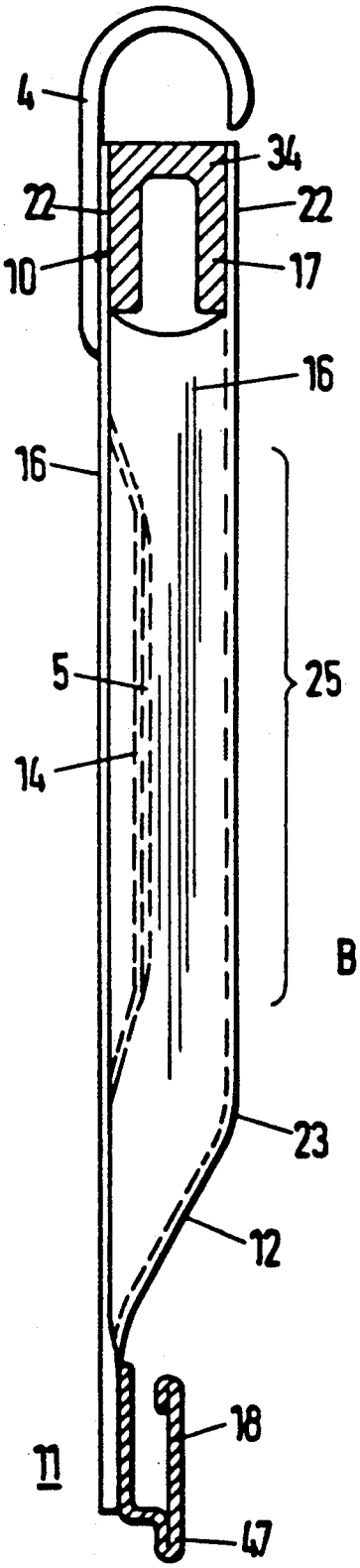
FIG. 2*a* shows another example of a shaft rod having a trapezoidal contoured shell.
Figure 2B:
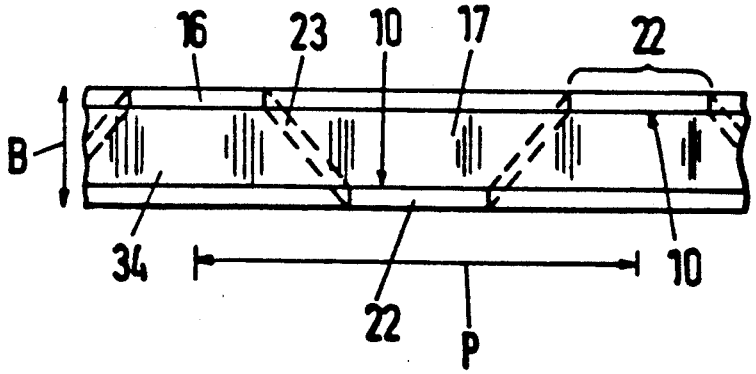
FIG. 2*b* is a plan view of the rod shown in FIG. 2*a;*

FIGS. 2*a* and 2*b* show a shaft rod having a trapezoidal contoured shell 23. The same divides at its outer end and merges into two parallel plane interrupted edge strips 22. The longitudinal reinforcement 17, which is in the form of a steel section 34 in this case, is inserted by way of a large area between the edge strips 22 and bonded there to. This also helps to provide a lightweight flexurally rigid rod shape having satisfactory force relationships.

Another advantage of the contoured shell rods according to the invention is the possibility of simple production of connecting parts 13 for guide elements 4 and actuating elements 3 which ensure that forces are applied advantageously to the contoured shell. To this end, a fiber reinforced bearing surface 14 having the same thermoplastic matrix can be welded to the shell 16. A connection zone 13 for an actuating element 3 is formed thus in FIGS. 1*a*, 7 and 8. The run-out shape 49 of the UD section 32 in FIG. 1*a* provides a very advantageous continuous transmission of forces to the contoured shell structure.

In the example shown in FIGS. 2*a* and 2*b* a connecting part 13 having a bearing surface 14 for securing a guide element 4 is shown. A connection zone 5 is formed by thermoplastic reshaping and, depending upon the forces to be dealt with, with or without an additional bearing surface 14, in the central zone 25 of the rod cross-section, such zone receiving the connection to the side supports 2 of a heald frame, as will be described in greater detail with reference to FIGS. 7 and 9. The carrier bar is an easy-to-shape low-cost sheet steel section 47.

Figure 3:
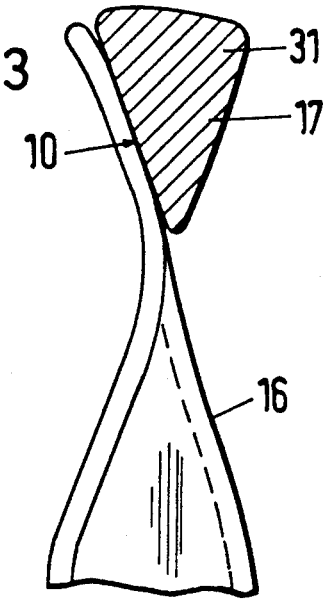
FIGS. 3 to 5 show examples of longitudinal reinforcements of the shaft rod.
Figure 4:
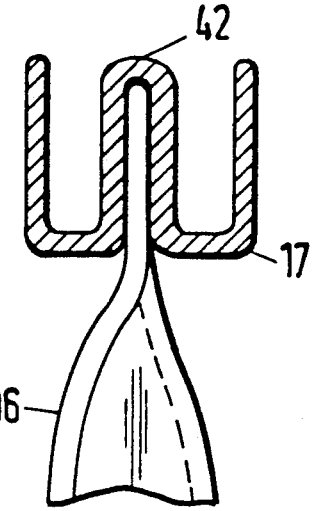
Figure 5:
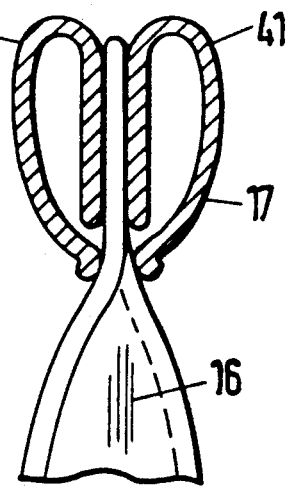

Other appropriate embodiments of the longitudinal reinforcement 17 are shown by way of example in FIGS. 3 to 5. FIG. 3 shows another UD section 31 welded to the shell 16. FIGS. 4 and 5 show other examples of low-cost sheet steel sections, viz. a very simple section 42 and a two-part section 41.

Figure 7:
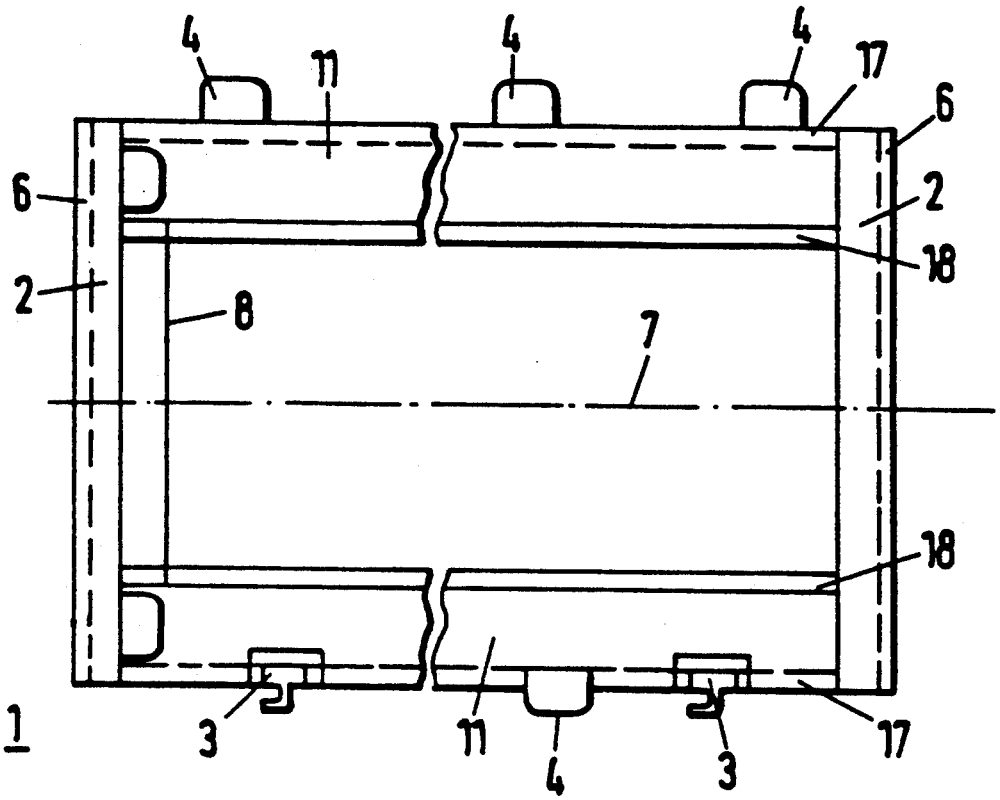
FIG. 7 shows a heald frame according to the invention which has a top and bottom shaft rod.

FIG. 7 shows a heald frame 1 having a top and bottom shaft rod 11 according to the invention. Heald frames having identical shaft rods arranged symmetrically of the frame center 7 are particularly simple to manufacture. The frame has side supports 2 having guide sections 6, actuating elements 3 and top and bottom guide elements 4.

Figure 8:
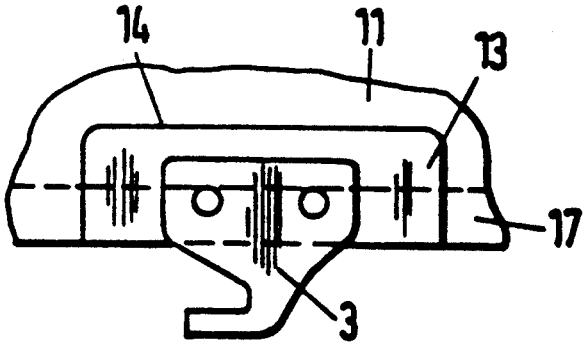
FIG. 8 shows a connecting part with actuating element.

The partial view of FIG. 8 shows the extent of a connection or transition zone 13 embodied by a welded bearing surface 14. The actuating element 3 is secured releasably, for example, by screwing, or is secured by bonding (cf. FIG. 1*a*).

Figure 9:
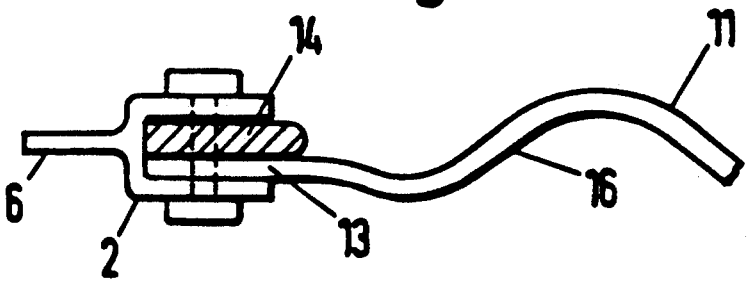
FIG. 9 shows a connection zone leading to the side supports of the heald frame.

FIG. 9 shows a connection of shaft rods 11 to side supports 2. A connection zone 5 (FIG. 2*a*) in the central zone of the contoured shell rod 11 is formed by a thermoplastics reduction of the shell 16 in association with a bearing surface 14 welded in therebetween. The side supports 2 can also be made of a thermoplastics composite material having extra-strong industrial fibers. In this event one side support can be rigidly welded to the shaft rod shell 16 while the second side support is connected releasably to enable the healds to be threaded.

What is claimed is:

1. A shaft rod for use on a heald frame of a loom, the shaft rod comprising an elongated, rigid reinforcement member defining an outside of the shaft rod; a carrier bar adapted to support heddles spaced from the reinforcement member and defining an inside of the shaft rod; a shell constructed of a fiber-reinforced thermoplastic material having a corrugation extending in a non parallel manner to a longitudinal orientation of the reinforcement member on the shaft rod and running from the reinforcement member to the carrier bar; and means mechanically rigidly connecting the reinforcement member and the carrier bar to the shell.

2. A shaft rod according to claim 1 wherein the shell has substantial areas which overlap corresponding areas of the reinforcement member and the carrier bar, and wherein the connecting means secure the shell to the member and the bar over said substantial areas.

3. A shaft rod according to claim 2 wherein the substantial area of the carrier bar has a height perpendicular to the reinforcement member, wherein the carrier bar has a thickness perpendicular to the height, and wherein the height of the substantial area is at least equal to the thickness of the carrier bar.

4. A shaft rod according to claim 1 wherein the carrier bar comprises a steel section.

5. A shaft rod according to claim 4 wherein the carrier bar comprises a sheet steel section.

6. A shaft rod according to claim 1 wherein the reinforcement member comprises a steel section.

7. A shaft rod according to claim 1 wherein the reinforcement member comprises an aluminum section.

8. A shaft rod according to claim 6 wherein the reinforcement member comprises a sheet steel section.

9. A shaft rod according to claim 1 wherein the reinforcement member includes unidirectional reinforcing fibers selected from the group consisting of carbon fibers and glass fibers.

10. A shaft rod according to claim 1 wherein the shell includes glass fibers comprising at least 50% of the weight of the shell.

11. A shaft rod according to claim 10 wherein the shell comprises glass fibers oriented at 45° relative to the longitudinal orientation of the reinforcement member.

12. A shaft rod according to claim 1 wherein the shell comprises a plastic material selected from the group consisting of polyphenylene sulfide, polyether imide, polyamide, polyether sulfon, polysulfone, polyurethane or polyethylene.

13. A shaft rod according to claim 1 including a plurality of corrugations having, in cross-section, an undulating shape.

14. A shaft rod according to claim 1 wherein the corrugation, in cross-section, has a trapezoidal shape.

15. A shaft rod according to claim 1 wherein the corrugation extends substantially perpendicular to the reinforcement member and the carrier bar.

16. A shaft rod according to claim 1 including a plurality of adjacent corrugations spaced from each other by a period P and having a width B between high points and low points of the corrugations, and wherein the ratio P:B is between 3 and 8.

17. A shaft rod according to claim 1 wherein the shell includes a flat inner edge strip and a flat outer edge strip integrally constructed with a portion of the shell defining the corrugation, and wherein the carrier bar and the reinforcement member are mechanically rigidly connected to the inner and outer edge strips, respectively.

18. A shaft rod according to claim 1 wherein the shell includes first and second, opposing, spaced-apart, flat and parallel shell edge strips extending along an edge of the shell.

19. A shaft rod according to claim 1 including a plurality of strengthened connection zones formed on the shell, the connection zones being defined by the shell and a flat reinforcing plate secured to the shell.

20. A shaft rod according to claim 1 including a side support secured to the shell and disposed between the reinforcement member and the carrier bar, and thermoplastically formed connection zones for the side support on the shell.

21. A shaft rod according to claim 1 wherein the shell comprises a sheet.

22. A substantially flat shaft rod for use on a heald frame of a loom, the shaft rod comprising an elongated, substantially linear, rigid reinforcement member defining an outside of the shaft rod; an elongated carrier bar adapted to support heddles spaced from and disposed in a common plane with the reinforcement member and defining an inside of the shaft rod; a contoured shell constructed of a fiber-reinforced thermoplastic material having corrugations oriented in a non parallel manner to a longitudinal orientation of the reinforcement member on the shaft rod and running transversely from the reinforcement member to the carrier for; and means mechanically rigidly connecting the reinforcement member and the carrier bar to the shell.

23. A heald frame for a loom, the frame comprising first and second, spaced-apart shaft rods, each shaft rod including an elongated, rigid reinforcement member forming an outer side of the shaft rod, a carrier bar spaced from and disposed in substantially a common plane with the reinforcement member and defining an inner side of the shaft rod, a contoured shell constructed of a fiber-reinforced plastic material having corrugations extending in a non parallel manner to a longitudinal orientation of the reinforcement member on the shaft rod and running transversely from about the reinforcement member to about the carrier bar, and means mechanically rigidly connecting the reinforcement member to the carrier bar; and means connecting the shaft rods to each other so that the reinforcement members of the shaft rods define outer sides of the heald frame.

24. A heald frame according to claim 23 wherein the first and second shaft rods are identically constructed and arranged symmetrically about a center line of the heald frame which is parallel to the reinforcement members.

25. A heald frame according to claim 23 wherein the means connecting the shaft rods comprise connecting elements having relatively large areas overlapping corresponding areas defined by the shell, and means rigidly connecting the overlapping areas of the connecting members and the shell to each other.

26. A heald frame according to claim 23 wherein the means connecting the shaft rods comprise first and second lateral supports constructed of a fiber-reinforced thermoplastic material and secured to the shell.

* * * * *